US006397473B1

(12) United States Patent
Clark

(10) Patent No.: US 6,397,473 B1
(45) Date of Patent: Jun. 4, 2002

(54) SHAVING SYSTEM WITH UNIFORM SHAVING FORCES

(75) Inventor: Gregory Clark, Weston, CT (US)

(73) Assignee: Warner-Lambert Company, Morris Plains, NJ (US)

( * ) Notice: Subject to any disclaimer, the term of this patent is extended or adjusted under 35 U.S.C. 154(b) by 0 days.

(21) Appl. No.: 09/105,797

(22) Filed: Jul. 25, 1997

Related U.S. Application Data

(63) Continuation of application No. 08/622,214, filed on Mar. 27, 1996, now abandoned.

(51) Int. Cl.[7] ..... B26B 21/16; B26B 21/22
(52) U.S. Cl. ..... 30/50; 30/57; 30/77
(58) Field of Search ..... 30/49, 50, 57, 30/77, 79

(56) References Cited

U.S. PATENT DOCUMENTS

| | | | | | |
|---|---|---|---|---|---|
| 4,270,268 | A | * | 6/1981 | Jacobson | 30/50 |
| 4,516,320 | A | * | 5/1985 | Peleckis | 30/50 |
| 5,003,694 | A | * | 4/1991 | Chen | 30/50 |
| 5,222,300 | A | * | 6/1993 | Althaus et al. | 30/50 |
| 5,224,267 | A | * | 7/1993 | Simms et al. | 30/50 |
| 5,251,376 | A | * | 10/1993 | Althaus et al. | 30/50 |
| 5,253,420 | A | * | 10/1993 | Althaus et al. | 30/50 |
| 5,347,714 | A | | 9/1994 | Prochaska | 30/50 |
| 5,369,885 | A | * | 12/1994 | Ferraro | 30/41 |
| 5,416,974 | A | * | 5/1995 | Wain | 30/50 |
| 5,822,862 | A | * | 10/1998 | Ferraro | 30/50 |

FOREIGN PATENT DOCUMENTS

| | | |
|---|---|---|
| DE | 9108212 | 10/1992 |
| EP | 0314266 | 3/1989 |
| FR | 2660589 | 11/1991 |
| WO | 9114546 | 10/1991 |
| WO | 9119597 | 12/1991 |
| WO | 9529798 | 11/1995 |

* cited by examiner

*Primary Examiner*—Hwei-Siu Payer
(74) *Attorney, Agent, or Firm*—Peter C. Richardson; Gregg C. Benson; Raymond D. Thompson

(57) ABSTRACT

Shaving systems are designed to provide greater uniformity to shaving forces over the skin-engaging portion of the skin-engaging element, such as a blade, guard element or cap member. According to one embodiment, at least one, and preferably a plurality of flexible blades are movably connected to a support by biasing members. One embodiment comprises a razor head comprising a plurality of blades which are movably connected to a flexible support structure in a manner which permits movement of the blades independent of the flexing of the blade(s) or the flexible support. According to another embodiment, at least one and most preferably a plurality of blades are connected to a support block which is movably supported in a "floating" manner within a housing by biasing members.

5 Claims, 5 Drawing Sheets

SHAVING SYSTEM WITH UNIFORM SHAVING FORCES

This is a continuation of application Ser. No. 08/622,214 filed on Mar. 27, 1996 now abandoned.

The present invention is directed to shaving systems and, more particularly, to shaving systems designed to provide uniform shaving forces.

BACKGROUND OF THE INVENTION

Relatively recent advances in shaving systems have included a variety of dynamic razors wherein one or more of a guard member, seat blade, and cap blade, move in response to forces encountered during shaving. Various systems which have been disclosed permit one or more blades to move in a single plane in response to shaving forces.

One such system described in U.S. Pat. No. 4,586,255 to Jacobson comprises a movable guard bar, and two movable blades, all of which are spring loaded in a supporting structure for movement in response to forces encountered during shaving. The sharpened blades are welded to blade supports which contact upwardly biased leaf springs. The movable guard member and blades are maintained within the supporting structure by metal bands which wrap around the ends of the cartridge. When the movable blades encounter forces during shaving, the blades are urged downwardly into the support structure to less aggressive shaving positions in order to minimize the risk of causing nicks and cuts. In light of the welding steps and the number of separate pieces which must be assembled during the manufacture of this cartridge, it would be desirable to provide a dynamic shaving system which can be manufactured quickly and at relatively low cost.

In this Jacobson design, as well as in numerous other dynamic shaving systems, blades and/or other skin-engaging elements are movably supported by a plurality of resilient spring members. Those skilled in the art will appreciate that any given spring member will exert a certain spring load force on the skin-engaging element to which it is connected. In order to move the skin-engaging element, a force greater than the spring load force must be applied to the skin-engaging element. If the force is applied immediately above the spring member, then a force marginally greater than the spring load force will cause movement of the skin-engaging element. However, in many of the previously suggested designs, skin-engaging elements such as blades are resiliently supported at positions close to either end of the skin-engaging element by at least two spring members. If a force is applied to that skin-engaging element at a midpoint between the spring members, then the force required to cause movement of the skin-engaging element must be greater than the cumulative spring load forces supplied by both of the spring members. Therefore, it will be appreciated that depending upon the point of application of pressure to such a spring loaded skin-engaging element, the forces required to cause movement of that skin-engaging element can vary widely, e.g., by factors of about two.

It would be therefore be desirable to provide greater uniformity to the forces required to move a movable skin-engaging element over the length of that skin-engaging element.

SUMMARY OF THE INVENTION

According to one preferred embodiment of the present invention, a shaving system comprises at least one, and preferably a plurality of flexible blades that are movably connected to a support by biasing members. One illustrated embodiment of the present invention comprises a flexible razor head comprising a plurality of blades which are movably connected to a flexible support structure in a manner which permits movement of the blades independent of the flexing of the flexible support. This embodiment of the present invention is designed to avoid the relatively significant load increases exhibited by rigid blade assemblies of the prior art between spring members.

According to another embodiment of the present invention, at least one and most preferably a plurality of blades are connected to a support block which is movably supported within a housing. The blade block is movably supported in a "floating" manner by biasing members such that at least one blade edge is movable in at least two, and most preferably at least three, different planes in response to forces encountered during shaving. An illustrated embodiment comprises biasing means which bias a blade block vertically, horizontally and laterally. The advantages of this embodiment of the present invention can be embodied in razor heads having rigid or flexible blades.

As used herein, the term "razor head" is meant to include cartridges which are designed and manufactured for attachment to a separate razor, as well as the operative portion of a disposable razor wherein the skin-engaging portions are integrally formed with a handle section.

DETAILED DESCRIPTION

Figure 1:
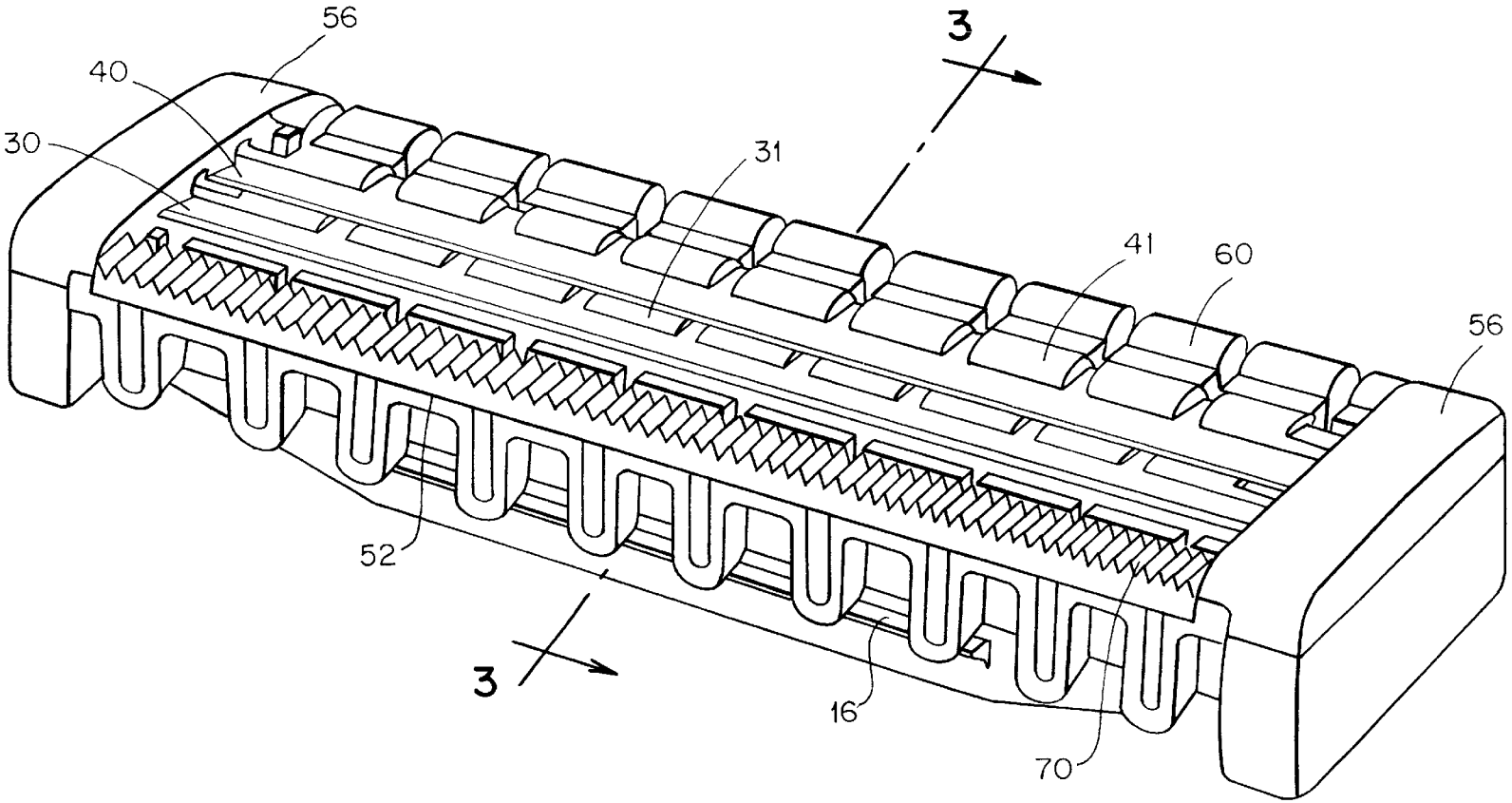
FIG. 1 is a perspective view of one preferred embodiment of the present invention.
Figure 2:
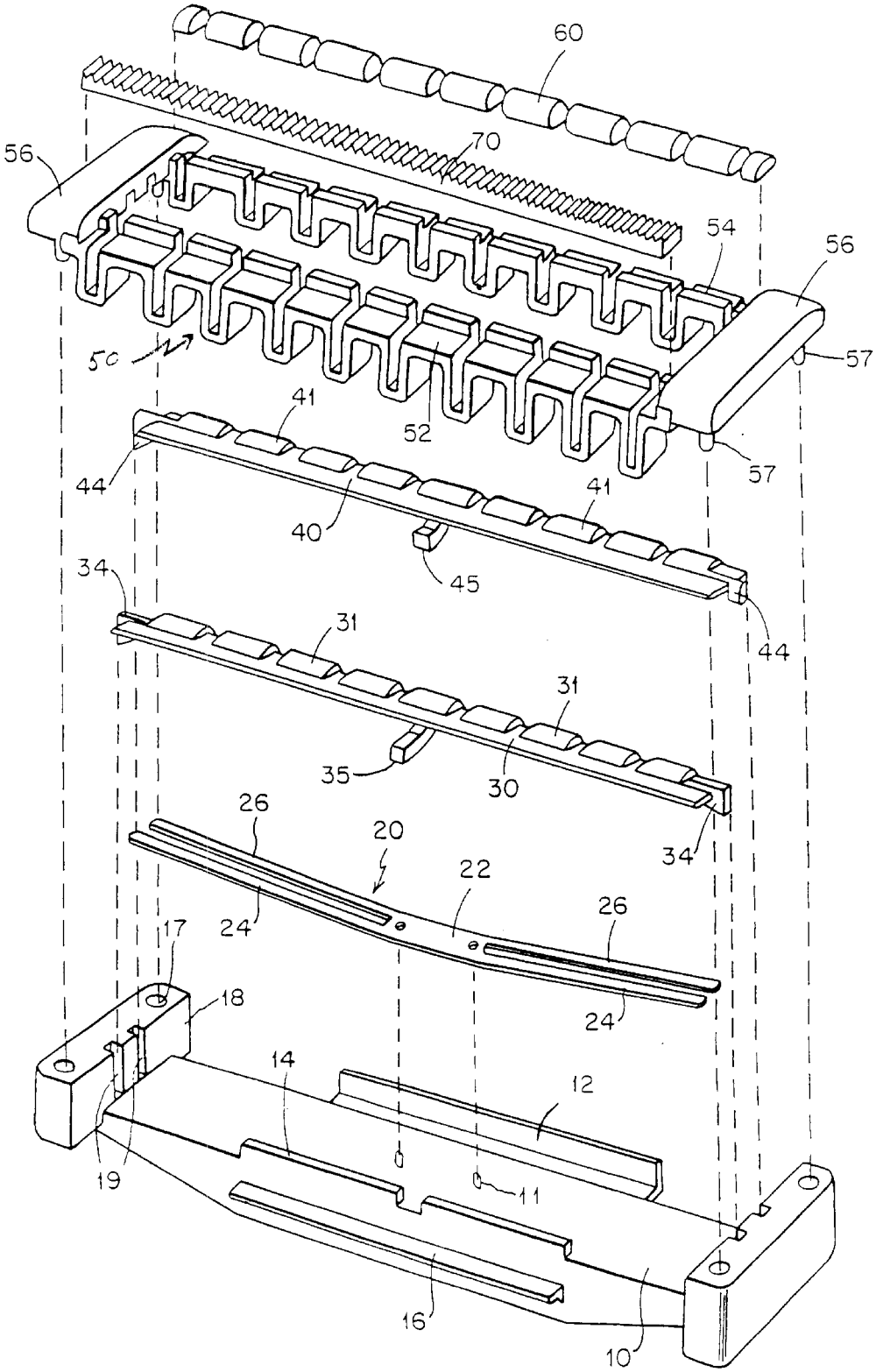
FIG. 2 is an exploded view of the embodiment of the present invention shown in FIG. 1.
Figure 3:
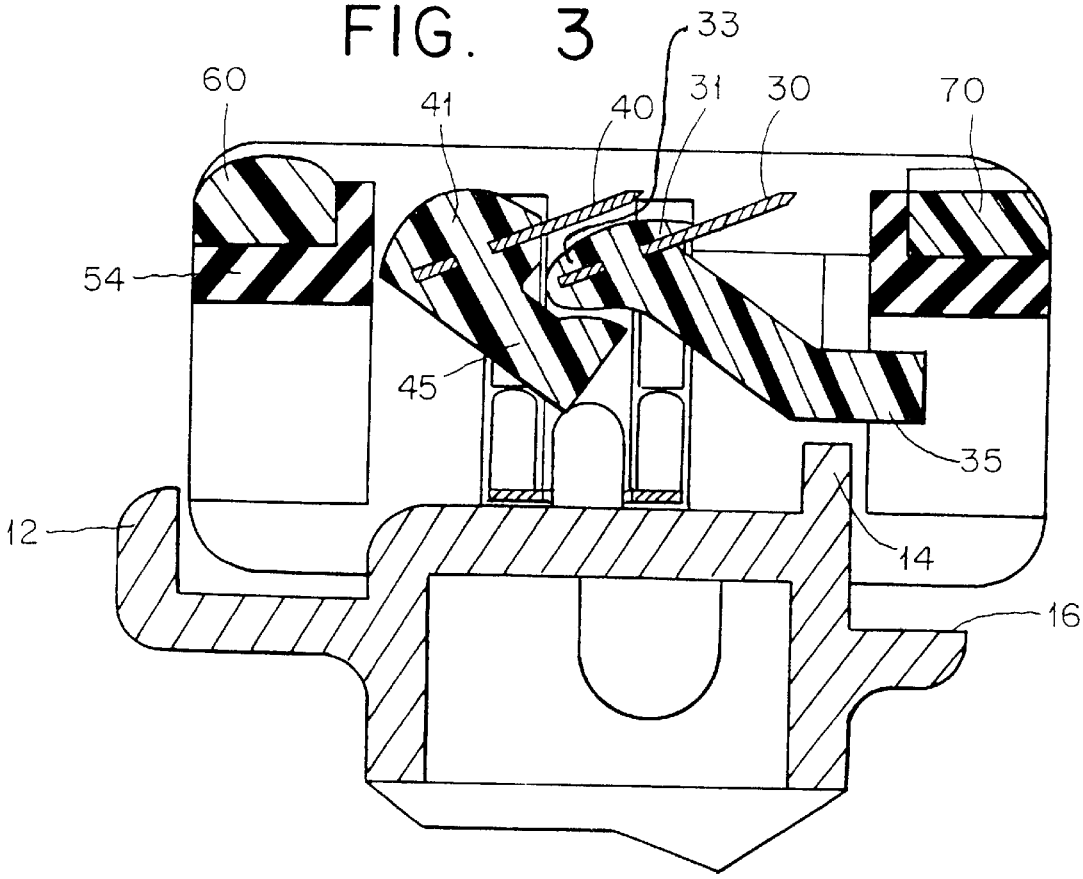
FIG. 3 is an enlarged cross-sectional view along lines 3—3 of the embodiment illustrated in FIG. 1.

The various embodiments of the present invention are designed to increase the uniformity of the shaving forces applied by different portions of skin-engaging elements, for example, blades, during shaving. One preferred embodiment to the present invention is illustrated in FIGS. 1–3. This illustrated embodiment comprises a plurality of flexible blades movably supported by a resilient spring member on a base. As best shown in FIG. 2, a base 10 comprises a cap stop 12, a forward guard stop 14, a lower guard shelf 16 and sidewalls 18 each comprising slots 19 and pin receptacles 17. Base 10 also comprises positioning pins 11 for properly aligning and positioning a generally H-shaped biasing member 20.

The biasing member 20 comprises a central support portion 22 having holes which align with pins 11 of base 10. A pair of forward spring members 24 extend laterally and generally upwardly from central support portion 22 for movably supporting forward blade supports 34 of flexible forward blade 30 while a pair of rearward spring members 26 extend in a similar fashion for resiliently supporting flexible blade supports 44 of a rear blade 40.

In this illustrated embodiment, forward blade 30 and rearward blade 40 comprise a plurality of discrete support segments 31, 41, respectively, which increase the structural integrity of the blades. Those skilled in the art will appreciate that the support segments can easily be molded onto the blades, for example, in an injection molding process. The shape and dimensions of the blade(s), as well as the number, shape, length and spacing of the support segments can be varied without departing from the scope of the present invention in order to limit the flexing capabilities to the blades. This embodiment of the present invention is capable of providing greater shaving force uniformity than rigid blades of the prior art when the force required to flex a blade is less than the sum of the loads of adjacent spring members. In one preferred embodiment, the subject skin-engaging element will flex under forces which are at least 25% less than the sum of such loads and most preferably under loads of about 50% of the sum of such loads.

The support segments at either ends of the blades are also provided with lateral extensions which are received within slots 19 of base sidewalls 18. According to this illustrated embodiment of the present invention, each blade is designed for vertical movement within slots 19 against the upwardly biasing force of biasing member 20. The lower portions of the blade supports which contact the spring members of biasing member 20 are preferably angled downwardly, however, these blade supports can have other configurations without departing from the scope of the present invention. Those skilled in the art will appreciate that the "upward" direction is relative and is made with reference to FIG. 2. Actually, the blades are biased by biasing member 20 in a direction toward a notional shaving plane regardless of the orientation of the shaving system. It will also be appreciated that by modifying the size and shape of the slots and the extensions of the blade supports 34 received within slots 19, it is possible to provide greater degrees of freedom, such as a pivoting action, to the blades without departing from the scope of the present invention.

Movement of the blades is coordinated to some degree by the cooperative engagement of the lower-rearward portions of central blade supports 35 and 45, best shown in FIG. 3. According to this illustrated embodiment, the blades have a limited amount of freedom for relative movement since the rear portion 33 of the forward blade support 31 is positioned to engage a forward extension of central blade support 45 when either of the blades move in response to forces encountered during shaving.

The blades 30, 40 and biasing member 20 are maintained in position by a flexible support cover 50 comprising a flexible segmented, guard support 52, a flexible, segmented cap portion 54, and sidewalls 56 from which pins 57 depend for engagement with recesses 17 in base sidewalls 18. In the manner illustrated, the segmented portions of guard support 52 are advantageously linked by corrugations, as are the segments of cap support 54 in order to enhance flexibility. Furthermore, a segmented shaving aid 60 is provided on the segmented portions of segmented cap 54 while a forward resilient skin-engaging element 70 is provided on the segmented guard surfaces 52 in order to provide desired sensations and stimulations. For example, resilient member 70 may advantageously be formed with a material having a higher coefficient of friction with wet skin than a rigid plastic of the type commonly used with disposable cartridges. The illustrated resilient material comprises a rubber-like texture and is connected to segments 52. The resilient material is preferably connected to the segments 52 in a sequential molding process. The resilient material 70 may comprise, for example, suitable corrosion-resistant, resilient materials such as Hercuprene 1000, 3000 series, Durometer 30 to 90 A scale available from J-Von, Leominster, Mass.; Kraton G series, Durometer 30 to 90 A scale available from Shell Chemical Co., Lisle, Ill.; and Santoprene 2271 series, Durometer 30 to 90 A scale available from Monsanto, Colo. While the illustrated resilient member 70 is formed as a unitary piece, it is also within the scope of the present invention to provide one or more discrete resilient members. The illustrated design is presently believed to be preferred since the resilient portion 70 prevents the free flow of skin through the spaces between the segmented support surfaces 52.

While this illustrated embodiment comprises two blades, the advantages of the present invention can be obtained with a single flexible and resiliently biased skin-engaging element. Those skilled in the art will appreciate that it is preferable to provide a plurality of blades and that a greater number of blades than those shown can also be utilized within the scope of the present invention. It is also within the scope of the present invention to utilize different forms of biasing members, different blade supports and different configurations of base covers. It is also within the scope of the present invention to provide a totally flexible blade support such as the blade support.

Other embodiments of the present invention are directed to shaving systems comprising at least one blade having the capability of moving in at least two different planes in response to forces encountered during shaving. Various embodiments of the present invention comprise rigid blades while other embodiments comprise flexible blades which are movably connected to a support structure.

From the present description, those skilled in the art will appreciate that the illustrated blades may move independently of the support structure in response to forces encountered during shaving. Therefore, when a blade experiences shaving forces, the blade is free to move to a less aggressive position even if the forces encountered by the razor head are not sufficient to cause flexing of the entire razor head.

While this illustrated embodiment comprises two flexible and independently movable blades within a flexible support structure, it is also within the scope of the present invention to utilize a single blade or a greater number of blades wherein at least one of the blades is both flexible and resiliently supported for movement independent of the flexing of the entire razor head.

Figure 4:
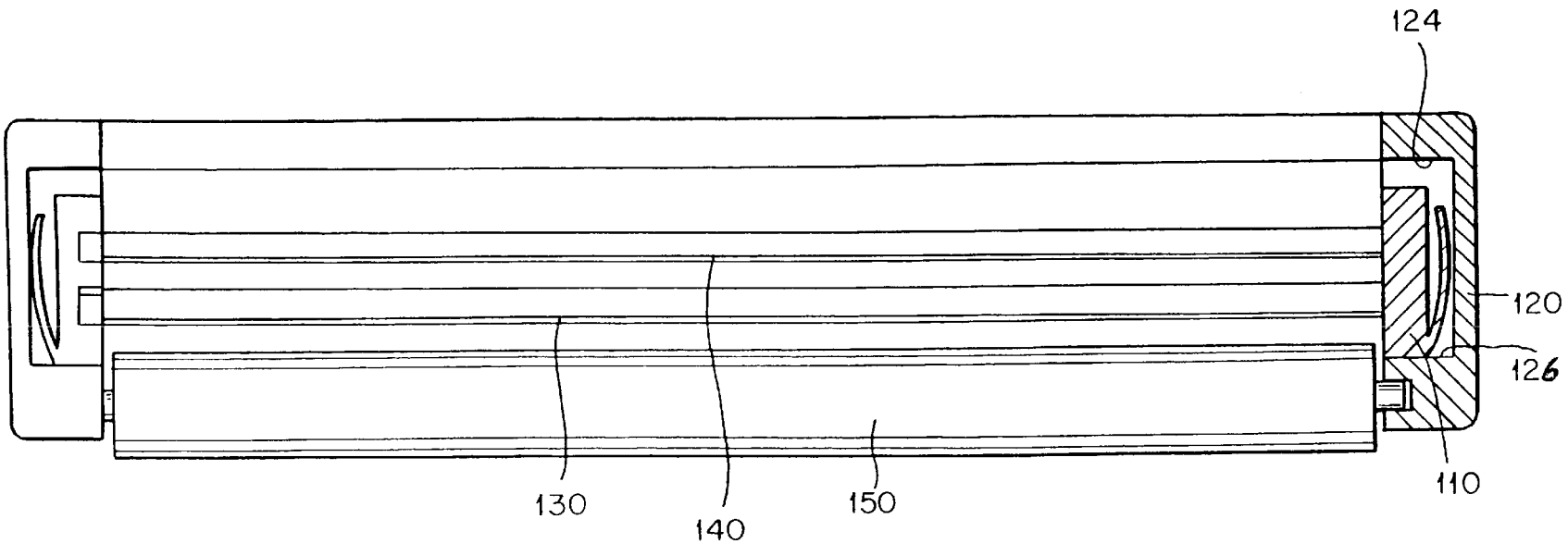
FIG. 4 is a top view with sections removed of an alternative embodiment of the present invention.
Figure 5:
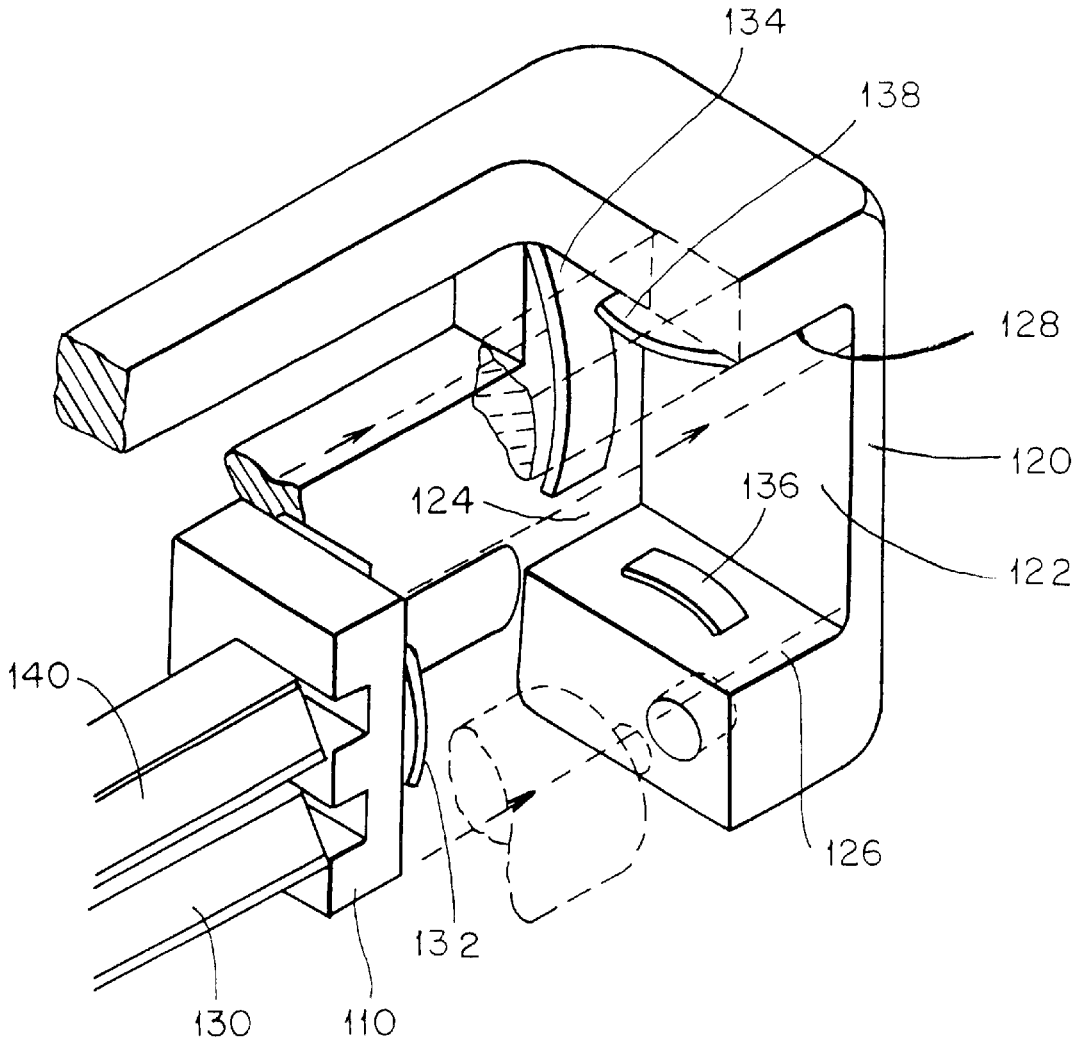
FIG. 5 is a partial, exploded view of an interior end portion of the embodiment illustrated in FIG. 4.

According to a further embodiment of the present invention illustrated in FIGS. 4 and 5, a blade block 110 is movably supported within a support structure 120. The blade block 110 of this illustrated embodiment supports a forward blade 130 and a rearward blade 140 for movement relative to a rotatable guard bar 150. As best shown in FIG. 5, the housing 120 comprises side walls 122, rear walls 124, lower interior walls 126 and upper interior wall 128. Support 120 may be flexible so that it will flex in response to forces encountered during shaving.

A plurality of spring members are positioned at both ends of the housing for movably supporting the blade block 110 in a "floating" manner within housing 120. Specifically, in this illustrated embodiment, lateral biasing springs 132 are positioned on the lateral ends of blade block 110 and normally contact interior side walls 122 of housing 120 in order to bias blade block 110 in the lateral direction. In a similar fashion, forward biasing members 134 are positioned on interior rear wall 124 in order to bias the blade block 110 forwardly while pairs of biasing members 136, 138 are positioned on lower interior surfaces 126 and upper interior surfaces 128, respectively, in order to bias the blade block 110 upwardly and downwardly.

From the present description, it will be appreciated that blade block 110 is free to move laterally, vertically, and horizontally (forwardly and rearwardly) in response to forces encountered during shaving.

Another aspect of the present invention comprises molded blade caps which move with the blades during shaving in order to maintain proper shaving geometry. Those skilled in the art will appreciate that movement of the blades without corresponding movement of the other skin-engaging members could result in shaving geometries which could result in uncomfortable shaves. In order to maximize the closeness and comfort of a shave, it has been recognized that it is desirable to carefully control various aspects of the shaving geometry of a shaving system. For example, the shaving angle, blade exposures and blade spans are three variables which are typically considered in the design of a shaving system. In order to maintain the desired flow of skin over the cutting edges of the blades of a multi-blade system, it is highly desirable to keep these dimensions of the shaving system within predetermined ranges. By providing a molded blade cap on at least one and preferably all of the movable blades, the angle at which the blade edges contact the skin during shaving can be controlled.

One or more of the skin-engaging surfaces of the various embodiments may comprise a shaving aid. As disclosed in U.S. Pat. No. 4,170,821 to Booth, which is hereby incorporated by reference, a shaving aid may comprise one or various combinations of the following:

A. A lubricating agent for reducing the frictional forces between the razor and the skin, e.g., a microencapsulated silicone oil.

B. An agent which reduces the drag between the razor parts and the shaver's face, e.g., a polyethylene oxide; a non-ionic polyacrylamide; and/or a natural polysaccharide derived from plant materials such as "guar gum".

C. An agent which modifies the chemical structure of the hair to allow the razor blade to pass through the whiskers very easily, e.g., a depilatory agent is one example.

D. A cleaning agent which allows the whisker and skin debris to be washed more easily from the razor parts during shaving, e.g., a silicon polyethylene oxide block copolymer and detergent such as sodium lauryl sulphate.

E. A medicinal agent for killing bacteria, or repairing skin damage and abrasions.

F. A cosmetic agent for softening, smoothing, conditioning or improving the skin.

G. A blood coagulant for the suppression of bleeding that occurs from nicks and cuts.

Alternatively, the shaving aid may comprise one or more of the shaving aids disclosed in U.S. Pat. No. 5,056,221 to Thoene, U.S. Pat. No. 4,044,120 to Rowsell et al., or U.S. Pat. No. 5,095,619 to Davis et al., which are also hereby incorporated by reference.

The shaving aid can be disposed on a movable skin-engaging element or on a separate fixed member.

From the present description, it will be appreciated that various embodiments of the present invention provide degrees of freedom for blades which have not heretofore been available with previous shaving systems.

What is claimed is:

1. A shaving system comprising:

a support;

at least one flexible blade including a plurality of support segments disposed thereon for selectively regulating the flexing characteristics of said flexible blade in response to the normal forces encountered during shaving; and means for movably supporting said flexible blade relative to said support, said supporting means extending substantially throughout the entire length of the blade and said supporting means enabling said flexible blade to move independent of said support in response to the normal forces encountered during shaving.

2. A shaving system according to claim 1 wherein said supporting means comprises at least one spring member for supporting said flexible blade.

3. A shaving system according to claim 1 wherein said supporting means comprises a plurality of spring members for supporting said flexible blade.

4. A shaving system according to claim 1 wherein said shaving system includes a plurality of flexible blades.

5. A shaving system according to claim 1 wherein said supporting means comprises biasing members disposed proximate each end of said flexible blade.

* * * * *